US010598132B2

(12) United States Patent
Timmer

(10) Patent No.: US 10,598,132 B2
(45) Date of Patent: Mar. 24, 2020

(54) METHOD FOR DIAGNOSIS OF A TANK VENTILATION VALVE BASED ON PRESSURE OSCILLATIONS

(71) Applicant: Dr. Ing. h.c. F. Porsche Aktiengesellschaft, Stuttgart (DE)

(72) Inventor: Markus Timmer, Leonberg (DE)

(73) Assignee: DR. ING. H.C.F. PORSCHE AKTIENGESELLSCHAFT, Stuttgart (DE)

( * ) Notice: Subject to any disclaimer, the term of this patent is extended or adjusted under 35 U.S.C. 154(b) by 208 days.

(21) Appl. No.: 15/704,008

(22) Filed: Sep. 14, 2017

(65) Prior Publication Data

US 2018/0135566 A1 May 17, 2018

(30) Foreign Application Priority Data

Nov. 15, 2016 (DE) ..... 10 2016 121 900

(51) Int. Cl.
*F02M 25/08* (2006.01)
*F02D 41/00* (2006.01)
*F02M 35/10* (2006.01)

(52) U.S. Cl.
CPC ..... *F02M 25/0809* (2013.01); *F02D 41/0032* (2013.01); *F02M 25/0836* (2013.01); *F02M 35/1038* (2013.01)

(58) Field of Classification Search
CPC ..... F02M 25/0809; F02M 35/1038
(Continued)

(56) References Cited

U.S. PATENT DOCUMENTS 5,476,083 A 12/1995 Blumenstock
7,011,076 B1 * 3/2006 Weldon ..... F02M 25/0836 123/516

(Continued)

FOREIGN PATENT DOCUMENTS

DE 4312721 A1 10/1994
DE 60210773 T2 4/2007

(Continued)

OTHER PUBLICATIONS

AutoZone, EVAP Canister Purge Valve & Vent Valve (Year: 2016).*

(Continued)

*Primary Examiner* — Peter J Macchiarolo
*Assistant Examiner* — David L Singer
(74) *Attorney, Agent, or Firm* — Leydig, Voit & Mayer, LTD.

(57) ABSTRACT

A method for diagnosis of a tank ventilation valve in a tank ventilation system for an internal combustion engine of a motor vehicle includes actuating a tank ventilation valve via a control unit, and checking the functionality of the tank ventilation valve in a manner dependent on a pressure oscillation measured by the pressure sensor. The tank ventilation system includes a filter having a first feed line from a fuel tank, a second feed line with a connection to a surrounding atmosphere, and a third feed line to a tank ventilation valve, wherein the tank ventilation valve has a connection to two different introduction points at an intake pipe, wherein the connection has a first line system and a second line system, wherein the tank ventilation system further includes at least one pressure sensor installed in the second line system between tank ventilation valve and intake pipe.

20 Claims, 1 Drawing Sheet

1: Control Unit
2: Fuel Tank
3: Filter
6a, 6b: Pressure Sensor
7: Venturi Nozzle

(58) Field of Classification Search
USPC ..... 73/114.39
See application file for complete search history.

(56) References Cited

U.S. PATENT DOCUMENTS

| | | | | |
|---|---|---|---|---|
| 2004/0040537 | A1* | 3/2004 | Esteghlal | F02M 25/0809 123/339.11 |
| 2004/0094133 | A1 | 5/2004 | Lingenhult et al. | |
| 2007/0044550 | A1* | 3/2007 | Kohler | F02M 25/0809 73/114.39 |
| 2007/0239330 | A1* | 10/2007 | Baumann | F02M 25/0818 701/33.7 |
| 2012/0211087 | A1 | 8/2012 | Dudar et al. | |
| 2013/0104857 | A1* | 5/2013 | Schulz | B60K 15/035 123/520 |
| 2014/0196694 | A1 | 7/2014 | Euliss et al. | |
| 2014/0209069 | A1* | 7/2014 | Peters | F02M 25/0809 123/520 |
| 2014/0251284 | A1 | 9/2014 | Plymale et al. | |
| 2014/0345574 | A1 | 11/2014 | Haefele | |
| 2016/0017849 | A1* | 1/2016 | Shirai | F02D 41/004 123/520 |
| 2016/0061124 | A1 | 3/2016 | Pflug et al. | |
| 2016/0069304 | A1 | 3/2016 | Guidi | |
| 2016/0201615 | A1* | 7/2016 | Pursifull | F02M 25/0836 123/520 |
| 2016/0298576 | A1* | 10/2016 | Reddy | F02M 25/089 |
| 2016/0326990 | A1* | 11/2016 | Pursifull | F02M 25/089 |
| 2018/0030937 | A1* | 2/2018 | Golladay | F01M 13/023 |

FOREIGN PATENT DOCUMENTS

| | | | | |
|---|---|---|---|---|
| DE | 102012201208 | A1 | 8/2012 | |
| DE | 102011084403 | A1 | 4/2013 | |
| DE | 102014100401 | A1 | 7/2014 | |
| DE | 102014204187 | A1 | 9/2014 | |
| DE | 102014012427 | A1 | 3/2016 | |
| DE | 102016202140 | A1 * | 8/2017 | |
| WO | WO-2017016737 | A1 * | 2/2017 | F01M 13/023 |

OTHER PUBLICATIONS

TLX Technologies, Canister Proportional Purge Solenoid Valve (Year: 2015).*
Cfrey, Diagnosing EVAP systems (Year: 2016).*
Timothy Hirzel, PWM, Arduino (Year: 2015).*
Jordandee, Pulse-width Modulation, sparkfun (Year: 2015).*
Mike Shorts, Understanding Check Valves: Sizing for the Application, Not the Line Size, WaterWorld (Year: 2007).*

* cited by examiner

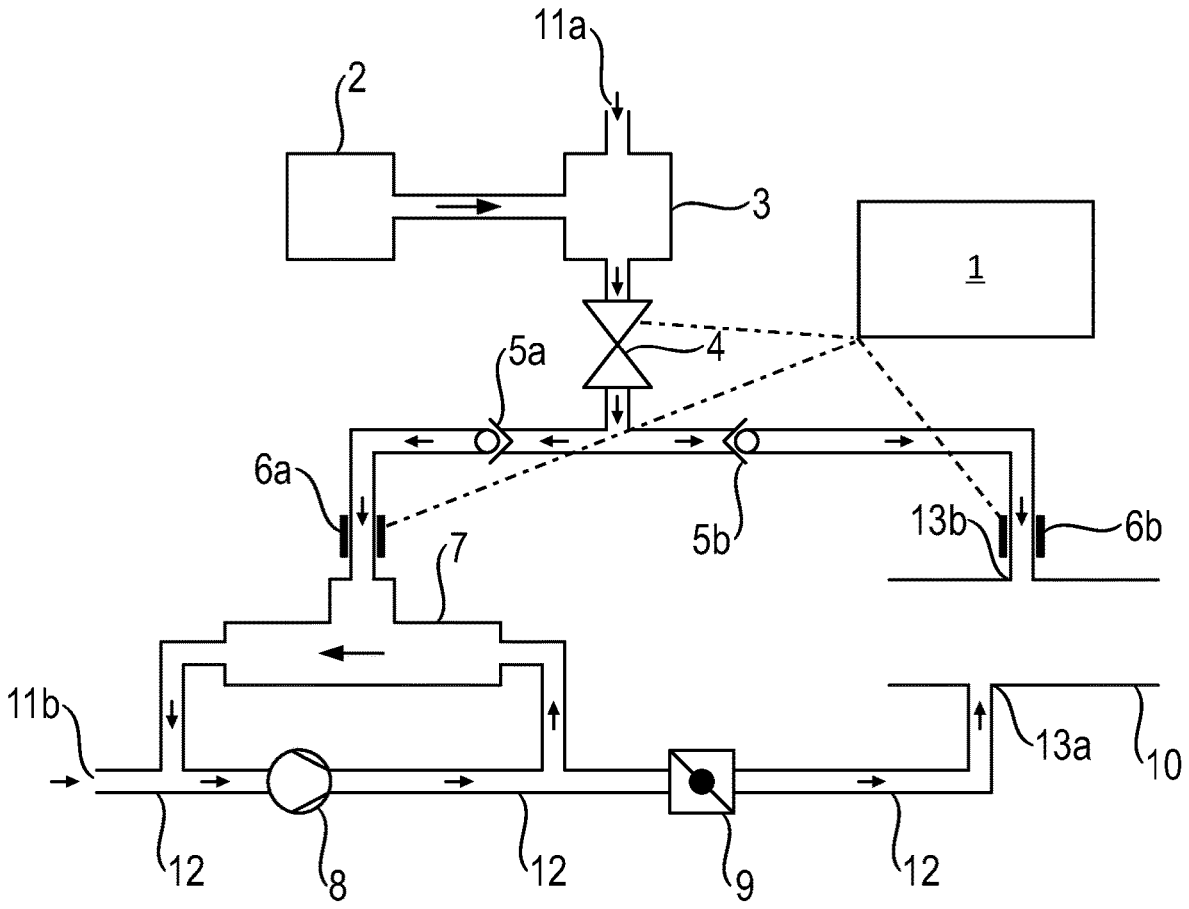
1: Control Unit
2: Fuel Tank
3: Filter
6a, 6b: Pressure Sensor
7: Venturi Nozzle

METHOD FOR DIAGNOSIS OF A TANK VENTILATION VALVE BASED ON PRESSURE OSCILLATIONS

CROSS REFERENCE TO RELATED APPLICATIONS

This application claims benefit to German Patent Application No. DE 10 2016 121 900.2, filed Nov. 15, 2016, which is hereby incorporated by reference herein.

FIELD

The present invention relates to a method for diagnosis of a tank ventilation valve in a tank ventilation system, in particular for an internal combustion engine of a motor vehicle.

BACKGROUND

Modern internal combustion engines in motor vehicles are equipped with systems for tank ventilation. These prevent highly volatile hydrocarbons situated in the fuel from passing into the environment.

For this purpose, the fuel tank is connected to a filter, preferably an activated carbon filter, which captures the hydrocarbons that escape from the fuel. The hydrocarbons that escape from the fuel accumulate in the filter. To ensure the functionality of the filter, it is necessary for the hydrocarbons that have accumulated there to be removed from the filter at regular intervals. This is performed in a purging process, in which the filter is purged with surroundings air. The filter is thereby regenerated.

The filter is connected via feed lines in each case to the fuel tank and to the surrounding atmosphere. The feed line from the fuel tank may preferably be equipped with at least one ventilation valve. The feed line from the surrounding atmosphere may preferably be equipped with a filter shut-off valve. The filter is connected via a further feed line to the intake pipe. A tank ventilation valve is situated in said feed line between the filter and intake pipe.

During the purging process, surroundings air is drawn from the surrounding atmosphere into the filter by means of negative pressure in the intake pipe with the tank ventilation valve open. In this way, the filter is purged with fresh air. The mixture of hydrocarbons and fresh air drawn out of the filter is supplied via the intake pipe to the internal combustion engine.

To comply with legal regulations, it must be possible to detect the functionality of the tank ventilation valve situated in the tank ventilation system through suitable diagnoses. In particular, it must be possible to identify a defective tank ventilation valve through suitable diagnoses.

Previous methods for diagnosis of the tank ventilation system are based on a diagnostic process performed additionally for this purpose, in which the functionality of the tank ventilation valve is inferred either from the resulting fuel-air mixture at the internal combustion engine or from the resulting pressure in the intake pipe.

For example, for diagnosis of the functionality from the resulting pressure in the intake pipe, in a first step, the tank ventilation valve is closed. In a second step, a settling phase is allowed to elapse. In a third step, the tank ventilation valve is opened with a targeted opening pattern. In a fourth step, with the aid of a pressure sensor, the pressure prevailing in the intake pipe and/or in the feed line between intake pipe and tank ventilation valve is determined. In a final evaluation step, a correlation factor is determined from the measured pressure and the applied opening pattern. With this factor, the functionality of the tank ventilation valve is monitored.

A disadvantage of the previous method is that, for carrying out the diagnosis, the operational tank ventilation must be interrupted. The interruption of the operational tank ventilation results in a reduction of the purging flow rate. Furthermore, in the event of an interruption of the diagnosis process, for example owing to changed operating conditions, the diagnosis process must be repeated, which further reduces the purging flow rate.

SUMMARY

In an embodiment, the present invention provides a method for diagnosis of a tank ventilation valve in a tank ventilation system for an internal combustion engine of a motor vehicle, wherein the tank ventilation system includes a filter having a first feed line from a fuel tank, a second feed line with a connection to a surrounding atmosphere, and a third feed line to a tank ventilation valve, wherein the tank ventilation valve has a connection to two different introduction points at an intake pipe, wherein the connection has a first line system and a second line system, wherein the tank ventilation system further includes a pressure sensor installed in the second line system between tank ventilation valve and intake pipe. The method includes actuating the tank ventilation valve via a control unit, and checking the functionality of the tank ventilation valve in a manner dependent on a pressure oscillation measured by the pressure sensor.

BRIEF DESCRIPTION OF THE DRAWINGS

The present invention will be described in even greater detail below based on the exemplary FIGURES. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following:

The FIGURE schematically illustrates a tank ventilation system with tank ventilation valve for diagnosis of the tank ventilation valve in accordance with a method according to an embodiment of the invention.

DETAILED DESCRIPTION

A method and a device for diagnosis of a tank ventilation valve are described herein, which method reduces the purging flow rate loss occurring as a result of the diagnosis in relation to previous methods, and which method has a short diagnosis duration in relation to previous methods.

A method for diagnosis of a tank ventilation valve in a tank ventilation system is contemplated herein, in particular for an internal combustion engine of a motor vehicle, wherein the tank ventilation system has a filter, wherein the filter has a first feed line from a fuel tank, wherein the filter has a second feed line with a connection to the surrounding atmosphere, wherein the filter has a third feed line to a tank ventilation valve, wherein the tank ventilation valve has a connection to two different introduction points at an intake pipe, wherein the connection has a first line system and a second line system, wherein the tank ventilation system has at least one pressure sensor installed in the second line system between tank ventilation valve and intake pipe, wherein the tank ventilation valve is actuated by means of a control unit, characterized in that the functionality of the tank ventilation valve is checked in a manner dependent on a pressure oscillation measured by the pressure sensor.

A method according to the invention advantageously makes it possible to perform a diagnosis of the tank ventilation system without interrupting the purging of the filter. The diagnosis of the tank ventilation valve is performed passively. No settling phase, during which the tank ventilation valve must remain closed, is required prior to the diagnosis. A purging flow rate loss associated with a settling phase is avoided. The diagnosis duration is determined by the duration of the pressure oscillation measurement. The diagnosis duration is thus reduced in relation to previous methods which are based on a settling phase preceding the diagnosis.

Owing to the reduced diagnosis duration, it is possible for the diagnosis method to be performed with greater diagnosis frequency. In this way, a method advantageously satisfies present and foreseeable future legal requirements with regard to diagnosis frequency.

In a preferred embodiment of the present invention, the filter is impermeable to hydrocarbons. The filter is preferably designed as an activated carbon filter. In a further preferred embodiment of the present invention, the feed line from the fuel tank to the filter is controlled by means of ventilation valves. The tank ventilation valve is preferably designed as a solenoid valve.

The filter is connected via a second feed line to the surrounding atmosphere. It is hereby advantageously possible for the filter to be purged with fresh air. Here, the purging flow rate is regulated by means of the tank ventilation valve. With the tank ventilation valve open, purging of the filter can take place, and with the tank ventilation valve closed, no purging of the filter can take place.

In a preferred embodiment of the present invention, the first line system serves predominantly for the purging of the filter when the engine is at part load. In a preferred embodiment of the present invention, the second line system serves predominantly for the purging of the filter when the engine is at full load.

In a preferred embodiment of the present invention, the tank ventilation valve is actuated by means of the control unit with a pulse-width-modulated signal. In a further preferred embodiment of the present invention, the duty cycle of the pulse-width-modulated signal is selected from an interval, wherein the interval is selected in a manner dependent on the operating state of the engine, wherein, in the case of a pressure oscillation being measured at the pressure sensor, it is inferred that the tank ventilation valve is functional.

In the context of the present invention, the duty cycle is a characteristic variable of the pulse-width-modulated signal and denotes the dimensionless quotient of pulse duration and period duration of the pulse-width-modulated signal. The duty cycle may be specified with a value range from 0 to 1 or as a percentage with a value range from 0% to 100%. Through variation of the duty cycle, the equivalent value of the pulse-width-modulated signal, and thus the equivalent value of the voltage applied to the tank ventilation valve, is varied. The purging flow rate can be controlled by means of the duty cycle.

In a preferred embodiment of the present invention, a first duty cycle is selected from a first interval when the engine is running at part load, and a second duty cycle which differs from the first is selected when the engine is running at full load. Here, the first interval is selected such that, during part-load operation of the engine, in the case of a functional tank ventilation valve, a pressure oscillation can be measured at the at least one pressure sensor situated in the second line system between the tank ventilation valve and intake pipe. Here, the second interval is selected such that, during full-load operation of the engine, in the case of a functional tank ventilation valve, a pressure oscillation can be measured at the at least one pressure sensor situated in the second line system between the tank ventilation valve and intake pipe.

If necessary, the actuation of the tank ventilation valve must be adapted for the duration of the diagnosis. In particular, it may be necessary to adapt the duty cycle for the duration of the diagnosis. It may preferably be necessary to adapt the actuation frequency of the tank ventilation valve for the duration of the diagnosis.

The purging flow rate loss that is caused by this is minimal owing to the short diagnosis duration, and is in particular negligible in relation to methods based on a diagnosis with a prior settling phase.

In a preferred embodiment of the present invention, in the absence of a pressure oscillation at the pressure sensor, it is inferred that the tank ventilation valve is non-functional.

In a defined interval of the actuation, that is to say in a defined interval of the duty cycle, a distinct pressure oscillation occurs at the pressure sensor situated in the second line system between tank ventilation valve and intake pipe. Said pressure oscillation can be used for diagnosis in different operating states of the engine. In this way, a method is advantageously provided which permits a diagnosis of the tank ventilation valve both when the engine is operating at part load and when the engine is operating at full load.

In this way, it is furthermore the case that a method for diagnosis of a tank ventilation valve is provided which has a short diagnosis duration. The diagnosis duration is determined by the duration of the pressure oscillation measurement. The diagnosis duration preferably amounts to one second. Previous diagnosis methods based on a settling phase prior to the diagnosis have a diagnosis duration of five to eight seconds. In this way, a method is advantageously provided which permits a fivefold to eightfold diagnosis frequency.

In a preferred embodiment of the present invention, with the tank ventilation valve open, a fuel-air mixture is drawn into the first line system by a negative pressure prevailing in an intake pipe.

In the case of a negative pressure prevailing in the intake pipe, with the tank ventilation valve open, the filter is purged with fresh air. The fresh air passing into the filter displaces the hydrocarbons that have escaped from the fuel tank. The fuel-air mixture emerging from the filter passes, with the tank ventilation valve open, through the first line system into the intake pipe. The purging of the filter via the first line system preferably occurs when the engine is operating at part load.

In a preferred embodiment of the present invention, with the tank ventilation valve open, a fuel-air mixture is drawn into the second line system by a negative pressure generated in a venturi nozzle, wherein the venturi nozzle is operated by means of the extraction of a carrier flow from a surroundings line downstream of a compressor and upstream of a throttle flap, wherein the surroundings line connects an air filter to a second introduction point at the intake pipe via the compressor and via the throttle flap.

In a preferred embodiment of the present invention, the intake pipe is supplied with a fuel-air mixture not only via a first line system but also via a second line system. The second line system purges the filter, with the tank ventilation valve open, by means of a negative pressure generated by means of a venturi nozzle. The venturi nozzle is fed by means of a carrier flow. The carrier flow is extracted from a surroundings line downstream of a compressor and upstream of a throttle flap and is supplied to a point upstream of the compressor again having been enriched with the fuel-air mixture purged from the filter. The fuel-air mixture emerging from the filter passes, with the tank ventilation valve open, through the second line system into the venturi nozzle, then into the surroundings line upstream of the compressor, then passes the throttle flap, and then passes into the intake pipe.

In a preferred embodiment, the compressor is a turbocharger. The venturi nozzle is preferably operated by means of the charge pressure of the turbocharger.

The purging of the filter via the second line system preferably occurs when the engine is operating at full load.

In a preferred embodiment of the present invention, a first pressure in the first line system is measured by means of a first pressure sensor situated at the first introduction point at the intake pipe, wherein a second pressure in the second line system is measured by means of the pressure sensor situated at least in the second line between tank ventilation valve and intake pipe, wherein, after comparison of the first pressure with the second pressure, that one of the two line systems at which a relatively low negative pressure prevails is closed.

It is hereby preferably possible to switch between the two purging paths in a manner dependent on the prevailing pressure.

The FIGURE schematically illustrates a tank ventilation system with tank ventilation valve for diagnosis of the tank ventilation valve in accordance with the present invention. A fuel tank 2 has a feed line to a filter 3. It is hereby advantageously possible for highly volatile hydrocarbons which evaporate from the fuel to be captured in the filter 3. The filter 3 has a feed line to the surrounding atmosphere 11*a*. It is hereby advantageously possible for the filter to be purged with fresh air. The filter 3 furthermore has a feed line to a tank ventilation valve 4. The tank ventilation system is actuated by a control unit 1 by means of a pulse-width-modulated signal. The tank ventilation valve has a feed line which branches off in y-shaped fashion. Said feed line connects a first line system to a second line system and to the tank ventilation valve. The first line system has a check valve 5*b*. The first line system has a pressure sensor 6*b* at the introduction point 13*b* of the first line system at the intake pipe 10. It is hereby advantageously possible to determine the pressure prevailing in the first line system at the intake pipe. It is in particular advantageously possible for the first line system to be closed by means of the check valve 5*b* if purging of the filter by means of the first line system is not efficient enough, for example because too small a negative pressure prevails at the intake pipe. Said negative pressure is advantageously determined by means of the pressure sensor 6*b*.

The second line system has a check valve 5*a*. The second line system has a pressure sensor 6*a*. It is hereby advantageously possible to determine the pressure prevailing in the second line system. It is in particular advantageously possible for the second line system to be closed by means of the check valve 5*a* if purging of the filter by means of the second line system is not efficient enough, for example because too small a negative pressure prevails in the second line system. Said negative pressure is advantageously determined by means of the pressure sensor 6*a*.

The second line system furthermore has a venturi nozzle 7 which is fed by means of a carrier flow. The carrier flow is extracted from a surroundings line 12 downstream of a compressor 8 and upstream of a throttle flap 9 and is supplied to said surroundings line again downstream of a feed line to the surrounding atmosphere 11*b* and upstream of the compressor 8. The surroundings line opens into the intake pipe 10 at a second introduction point 13*a*.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A method for diagnosis of a tank ventilation valve in a tank ventilation system for an internal combustion engine of a motor vehicle, wherein the tank ventilation system includes a filter having a first feed line from a fuel tank, a second feed line with a connection to a surrounding atmosphere, and a third feed line to a tank ventilation valve, wherein the tank ventilation valve has a connection to two different introduction points at an intake pipe, wherein the connection has a first line system and a second line system, wherein the tank ventilation system further includes a second line system pressure sensor installed in the second line system between the tank ventilation valve and the intake pipe, the method comprising:

actuating the tank ventilation valve via a control unit;

checking the functionality of the tank ventilation valve in a manner dependent on a pressure oscillation measured by the second line system pressure sensor;

measuring a first pressure in the first line system by a first line system pressure sensor situated at the first introduction point at the intake pipe;

measuring a second pressure in the second line system by the second line system pressure sensor;

comparing the first pressure with the second pressure to determine a line system, selected from the first line system and the second line system, at which a relatively low negative pressure prevails; and closing the line system at which the relatively low negative pressure prevails.

2. The method as claimed in claim 1, wherein the tank ventilation valve is actuated by the control unit with a pulse-width-modulated signal.

3. The method as claimed in claim 2, wherein the duty cycle of the pulse-width-modulated signal is selected from an interval, wherein the interval is selected in a manner dependent on the operating state of the engine, wherein, in the case of a pressure oscillation being measured at the second line system pressure sensor, it is inferred that the tank ventilation valve is functional.

4. The method as claimed in claim 3, wherein, in the absence of a pressure oscillation at the second line system pressure sensor, it is inferred that the tank ventilation valve is non-functional.

5. The method as claimed in claim 4, wherein, with the tank ventilation valve open, a fuel-air mixture is drawn into the first line system by a negative pressure prevailing in the intake pipe.

6. The method as claimed in claim 1, wherein, with the tank ventilation valve open, a fuel-air mixture is drawn into the second line system by a negative pressure generated in a venturi nozzle, wherein the venturi nozzle is operated by extraction of a carrier flow from a surroundings line downstream of a compressor and upstream of a throttle flap, wherein the surroundings line connects a feed line to the surrounding atmosphere to the second introduction point at the intake pipe via the compressor and via the throttle flap.

7. The method as claimed in claim 6, wherein the compressor is a turbocharger for the engine.

8. The method as claimed in claim 1, further comprising:

actuating the tank ventilation valve via the control unit based on a measured load of the engine.

9. The method as claimed in claim 8, further comprising:

actuating the tank ventilation valve via the control unit based on the measured engine load such that the control unit applies a first duty cycle to the tank ventilation valve during partial-load operation of the engine and the control unit applies a second, different duty cycle to the tank ventilation valve during full-load operation of the engine.

10. The method as claimed in claim 1, wherein the first line system comprises a first check valve disposed between the tank ventilation valve and the first line system pressure sensor and the second line system comprises a second check valve disposed between the tank ventilation valve and the second line system pressure sensor situated at least in the second line.

11. The method as claimed in claim 10, further comprising:

closing the first line system by closing the first check valve; and closing the second line system by closing the second check valve.

12. A method for diagnosis of a tank ventilation valve in a tank ventilation system for an internal combustion engine of a motor vehicle, wherein the tank ventilation system includes a filter having a first feed line from a fuel tank, a second feed line with a connection to a surrounding atmosphere, and a third feed line to a tank ventilation valve, wherein the tank ventilation valve has a connection to two different introduction points at an intake pipe, wherein the connection has a first line system and a second line system, wherein the tank ventilation system further includes a pressure sensor installed in the second line system between the tank ventilation valve and the intake pipe; the method comprising:

actuating the tank ventilation valve via a control unit; and checking the functionality of the tank ventilation valve in a manner dependent on a pressure oscillation measured by the pressure sensor;

wherein the tank ventilation valve is actuated by the control unit with a pulse-width-modulated signal;

wherein the duty cycle of the pulse-width-modulated signal is selected from an interval, wherein the interval is selected in a manner dependent on the operating state of the engine, wherein, in the case of a pressure oscillation being measured at the pressure sensor, it is inferred that the tank ventilation valve is functional;

wherein, in the absence of a pressure oscillation at the pressure sensor, it is inferred that the tank ventilation valve is non-functional;

wherein, with the tank ventilation valve open, a fuel-air mixture is drawn into the first line system by a negative pressure prevailing in the intake pipe;

wherein, with the tank ventilation valve open, a fuel-air mixture is drawn into the second line system by a negative pressure generated in a venturi nozzle, wherein the venturi nozzle is operated by extraction of a carrier flow from a surroundings line downstream of a compressor and upstream of a throttle flap, wherein the surroundings line connects a feed line to the surrounding atmosphere to the second introduction point at the intake pipe via the compressor and via the throttle flap; and wherein a first pressure in the first line system is measured by a first pressure sensor situated at the first introduction point at the intake pipe, wherein a second pressure in the second line system is measured by the pressure sensor situated at least in the second line between tank ventilation valve and intake pipe, and wherein, after comparison of the first pressure with the second pressure, one of the two line systems at which a relatively low negative pressure prevails is closed.

13. The method as claimed in claim 12, wherein the compressor is a turbocharger for the engine.

14. The method as claimed in claim 12, further comprising:

actuating the tank ventilation valve via the control unit based on a measured load of the engine.

15. The method as claimed in claim 14, further comprising:

actuating the tank ventilation valve via the control unit based on the measured engine load such that the control unit applies a first duty cycle to the tank ventilation valve during partial-load operation of the engine and the control unit applies a second, different duty cycle to the tank ventilation valve during full-load operation of the engine.

16. The method as claimed in claim 12, wherein the first line system comprises a first check valve disposed between the tank ventilation valve and the first pressure sensor and the second line system comprises a second check valve disposed between the tank ventilation valve and the pressure sensor situated at least in the second line.

17. The method as claimed in claim 16, further comprising:

closing the first line system by closing the first check valve; and closing the second line system by closing the second check valve.

18. A method for diagnosis of a tank ventilation valve in a tank ventilation system for an internal combustion engine of a motor vehicle, wherein the tank ventilation system includes a filter having a first feed line from a fuel tank, a second feed line with a connection to a surrounding atmosphere, and a third feed line to a tank ventilation valve, wherein the tank ventilation valve has a connection to two different introduction points at an intake pipe, wherein the connection has a first line system and a second line system, wherein the tank ventilation system further includes a pressure sensor installed in the second line system between the tank ventilation valve and the intake pipe; the method comprising:

actuating the tank ventilation valve via a control unit; and checking the functionality of the tank ventilation valve in a manner dependent on a pressure oscillation measured by the pressure sensor;

wherein the tank ventilation valve is actuated by the control unit based on the operating state of the engine, wherein, in the case of a pressure oscillation being measured at the pressure sensor, it is inferred that the tank ventilation valve is functional;

wherein, in the absence of a pressure oscillation at the pressure sensor, it is inferred that the tank ventilation valve is non-functional;

wherein, with the tank ventilation valve open, a fuel-air mixture is drawn into the first line system by a negative pressure prevailing in the intake pipe;

wherein, with the tank ventilation valve open, a fuel-air mixture is drawn into the second line system by a negative pressure generated in a venturi nozzle, wherein the venturi nozzle is operated by extraction of a carrier flow from a surroundings line downstream of a compressor and upstream of a throttle flap, wherein the surroundings line connects a feed line to the surrounding atmosphere to the second introduction point at the intake pipe via the compressor and via the throttle flap; and wherein a first pressure in the first line system is measured by a first pressure sensor situated at the first introduction point at the intake pipe, wherein a second pressure in the second line system is measured by the pressure sensor situated at least in the second line between tank ventilation valve and intake pipe, and wherein, after comparison of the first pressure with the second pressure, one of the two line systems at which a relatively low negative pressure prevails is closed.

19. The method as claimed in claim 18, further comprising:

actuating the tank ventilation valve via the control unit based on the measured engine load such that the control unit applies a first duty cycle to the tank ventilation valve during partial-load operation of the engine and the control unit applies a second, different duty cycle to the tank ventilation valve during full-load operation of the engine.

20. The method as claimed in claim 18, wherein the compressor is a turbocharger for the engine.

* * * * *